US005868368A

United States Patent [19]

MacDonald

[11] Patent Number: 5,868,368

[45] Date of Patent: Feb. 9, 1999

[54] APPARATUS FOR MOLDING AND STORING BASEBALL AND SOFTBALL GLOVES

[76] Inventor: Neil MacDonald, 9400 Dawn Dr., Baltimore, Md. 21236

[21] Appl. No.: 821,662

[22] Filed: Mar. 19, 1997

[51] Int. Cl.[6] ..... F16M 11/00

[52] U.S. Cl. ..... 248/176; 211/33

[58] Field of Search ..... 473/422, 450, 473/458, 464; 248/499, 500, 176.1, 505, 154; 211/85.7, 33

[56] References Cited

U.S. PATENT DOCUMENTS 3,257,048 6/1966 Wolder ..... 248/176.1 X
4,150,806 4/1979 Dziuk ..... 248/154
4,162,580 7/1979 Hess ..... 248/231.71 X
4,253,594 3/1981 Parks ..... 248/505 X
4,367,572 1/1983 Zielenski ..... 248/505 X
4,637,610 1/1987 Carr ..... 473/458

*Primary Examiner*—Ramon O. Ramirez
*Attorney, Agent, or Firm*—Whiteford, Taylor & Preston L.L.P.; Steven E. Tiller, Esq.

[57] ABSTRACT

An apparatus for storing and forming baseball and softball gloves according to the principles of the present invention which include a base with a permanently affixed pedestal rising from the center of the base; a sphere, corresponding to the size of a baseball or softball, removably integral with the top of the pedestal; and a means for securing the baseball or softball glove to said sphere.

5 Claims, 4 Drawing Sheets

APPARATUS FOR MOLDING AND STORING BASEBALL AND SOFTBALL GLOVES

CROSS-REFERENCES TO RELATED APPLICATIONS

Not Applicable.

STATEMENT REGARDING FEDERALLY SPONSORED RESEARCH OF DEVELOPMENT

Not Applicable.

BACKGROUND OF THE INVENTION

1. Field of the Invention.

The present invention relates to an apparatus for the easy storage of a baseball or softball glove. Also, the invention provides an easy means for one to shape and form a glove, as well as a means for decoratively displaying a glove.

2. Description of the Related Art including Information Disclosed under 37 C.F.R. 1.97 and 1.98.

Not Applicable.

BRIEF SUMMARY OF INVENTION

The primary object of the present invention is to provide an apparatus for the easy storage of baseball and softball gloves.

A further object of the present invention is to provide a decorative means of storing and displaying a baseball or softball glove.

A still further object of the present invention is to provide a means of forming and shaping a baseball or softball glove.

A still further object of the present invention is to provide an apparatus which will aid in forming and shaping a baseball or softball glove into a number of shapes depending on the type and size of ball to be used.

A still further object of the present invention is to provide an apparatus for storing and forming baseball or softball gloves which is simple in design, and durable.

A still further object of the present invention is to provide an apparatus for storing and forming baseball or softball gloves which may be manufactured from a number of materials at an inexpensive cost.

These objects, as well as further objects and advantages of the present invention, will become readily apparent after reading the description of a non-limiting illustrative embodiment and viewing the accompanying drawings.

DETAILED DESCRIPTION OF THE INVENTION

Figure 1:
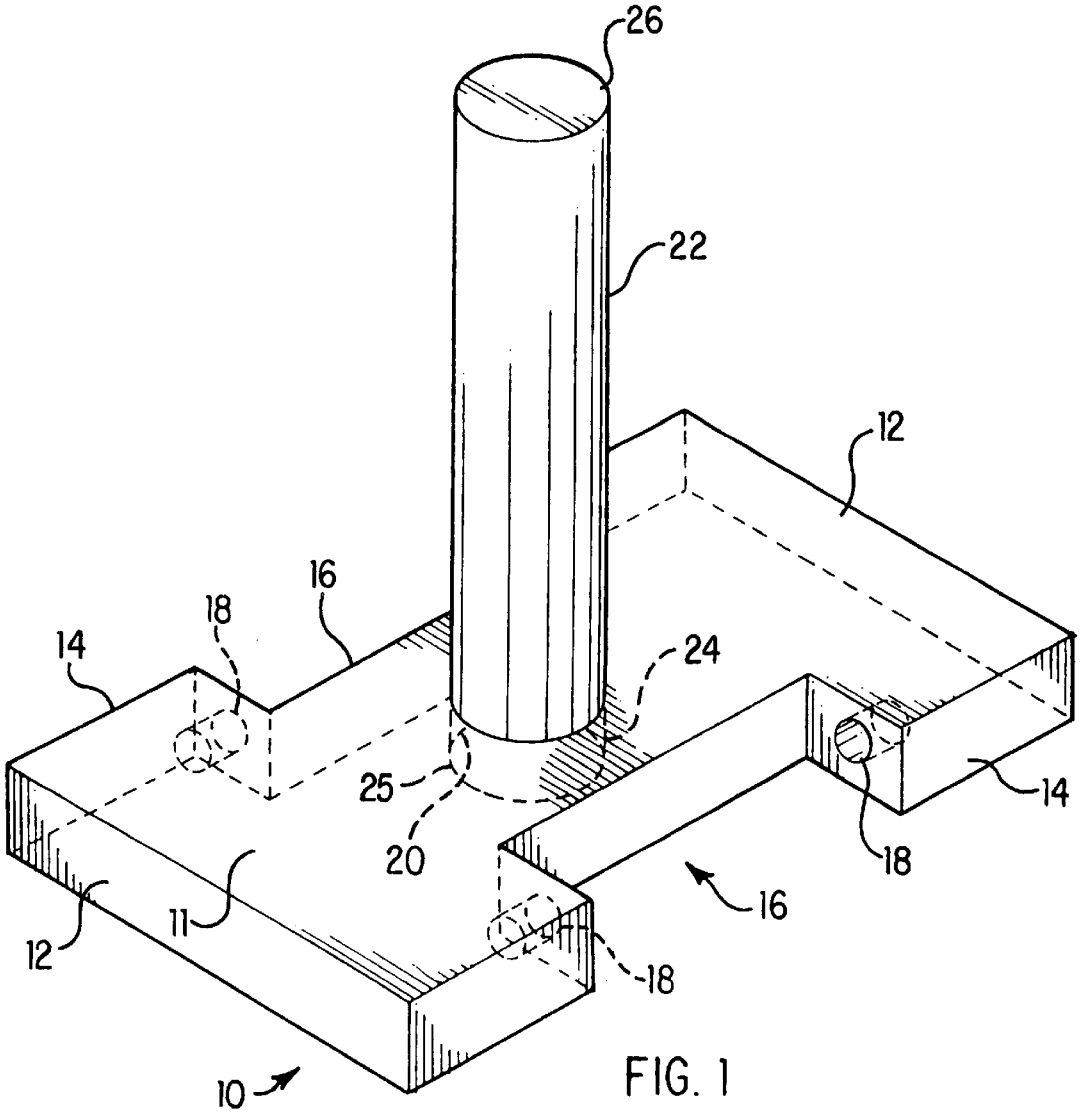
FIG. 1 is a plan view of the base and pedestal of the present invention without incorporating the sphere and means for securing a baseball or softball glove over said sphere.
Figure 2:
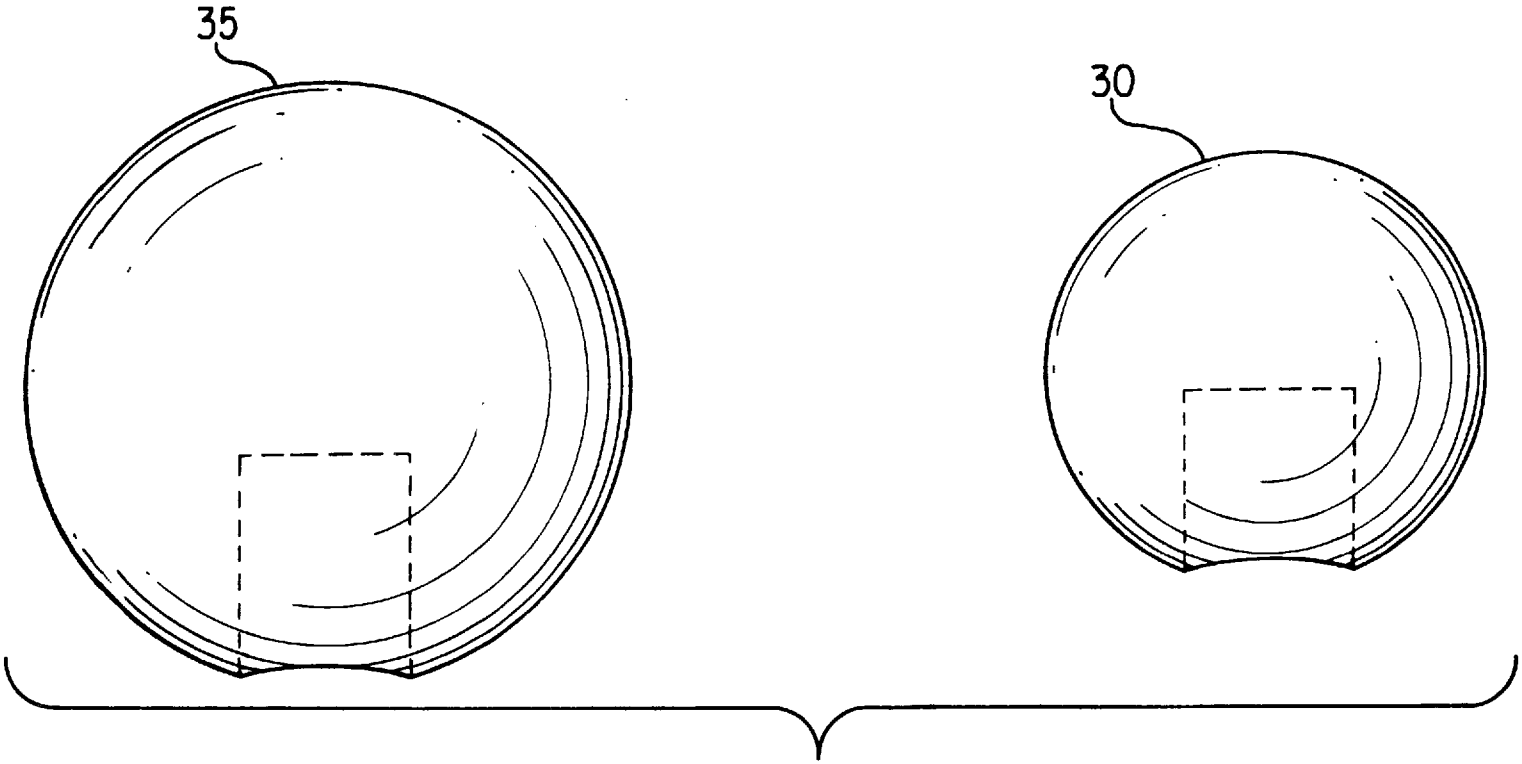
FIG. 2 is a plan view of the two removably secured spheres which may be positioned on the pedestal of the present invention; the first sphere corresponding with the size of a baseball while the second sphere corresponds with the size of a softball.
Figure 3:
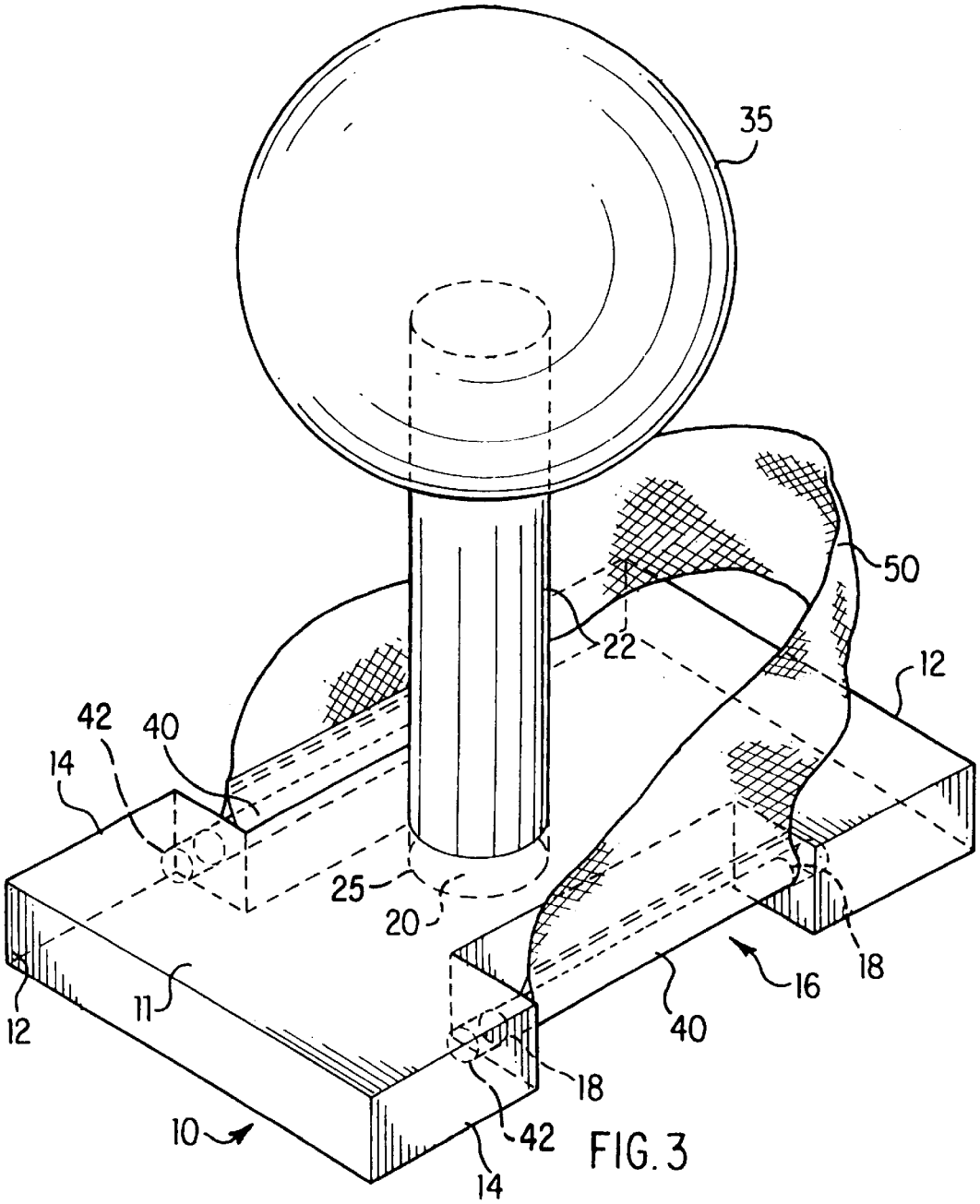
FIG. 3 is a plan view of the present invention.
Figure 4:
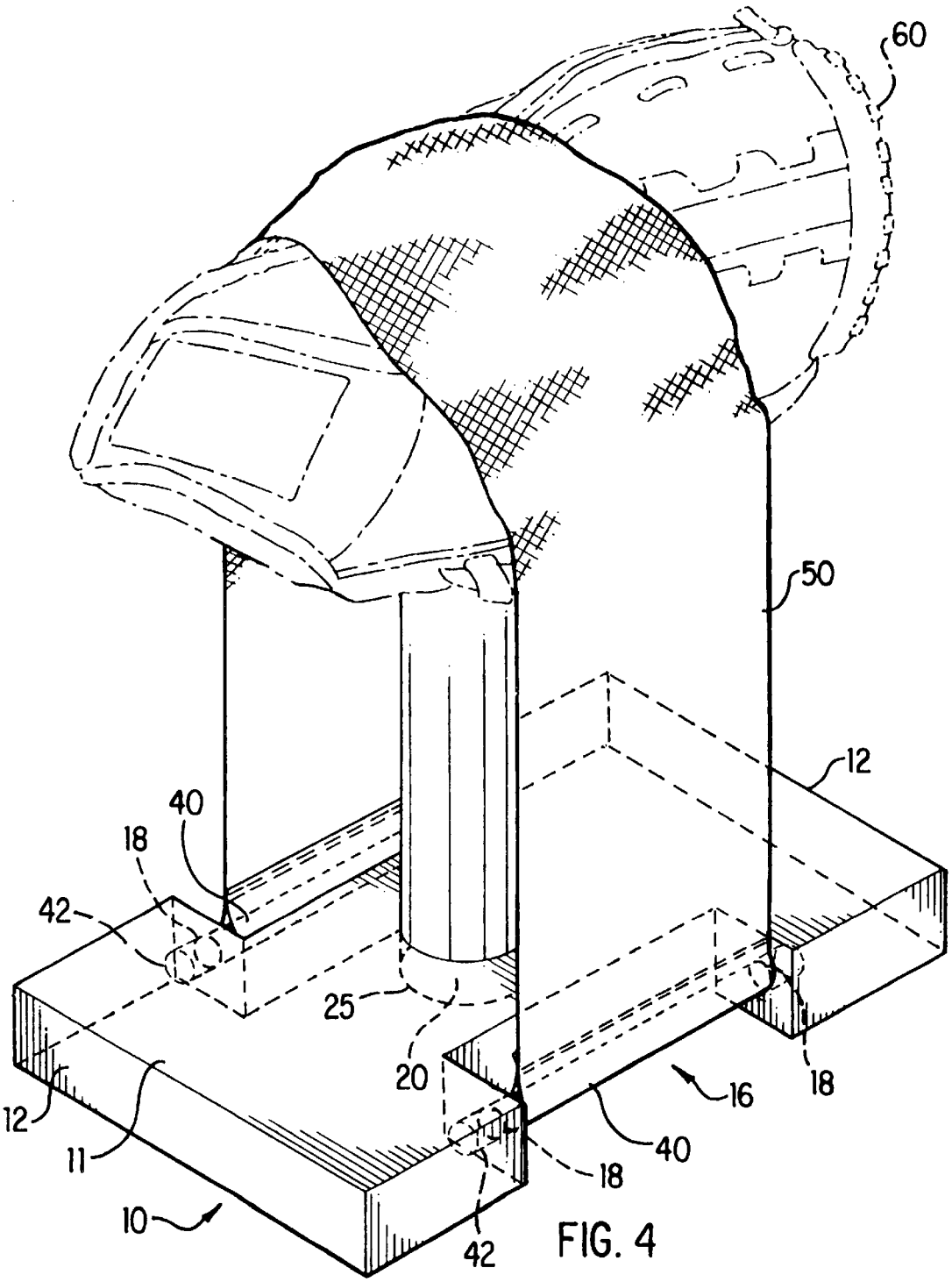
FIG. 4 is a plan view of the present invention incorporating a baseball or softball glove for molding, storage and display.

Referring now to the Figures, there is illustrated therein an apparatus for storing and forming baseball and softball gloves (10). The apparatus (10) includes a base (11) which may be formed from any one of a number of materials, and in a number of shapes, the preferred embodiment being a rectangular shape having two opposing short width ends (12), and two opposing long-length ends (14). Each long length end (14) of the base (11) includes an integrally formed indentation (16), such indentation (16) including opposing apertures (18) for receiving cylindrical rods (40). Said base (11) also includes a center (25). At the center (25) of the base (11) is a cylindrical pedestal (22) having first (24) and second (26) ends; said first end (24) being permanently affixed into an aperture (20) in the center of the base (11).

Removably secured to the second end (26) of the pedestal (22) is a sphere (30 or 35). The sphere (30 or 35) is formed from the same material as the base and pedestal, and has a diameter corresponding to the size of a baseball (30) or softball (35). The spheres may be easily interchanged on the pedestal.

The invention further includes a means for securing a baseball or softball glove (60) over the sphere for molding and shaping. In the preferred embodiment, the means for securing a baseball or softball glove (60) includes two cylindrical rods (40), each rod having two opposing ends (42) and removably secured to the opposing apertures (18) integrally formed in the indention (16) of the base (11). A stretchable strap (50) is positioned around said cylindrical rods (40) and over said sphere (30 or 35) in a manner to accept a baseball or softball glove for positioning over said sphere (30 or 35). The strap (50) is further positioned so as to apply downward pressure on the baseball or softball glove (60) positioned over the sphere (30 or 35) to aid in the molding and shaping of the glove (60).

A primary advantage of the present invention is to provide an apparatus for the easy storage and display of a baseball or softball glove.

A still further advantage of the present invention is to provide a means of molding and shaping a baseball or softball glove.

A still further advantage of the present invention is to provide an apparatus which will aid in the molding and shaping of a baseball or softball glove into a variety of shapes depending on the type and size of sphere which is used.

Still another advantage of the present invention is to provide an apparatus for the storing and molding baseball of softball gloves which is simple in design, and durable.

Still another advantage of the present invention is to provide an apparatus for the storing and molding baseball and softball gloves which may be manufactured from a number of materials, at an inexpensive cost.

While the invention has been described with referenced to specific embodiments thereof, it will be appreciated to those skilled in the art that numerous modifications, variations and embodiments are possible, and accordingly, all such modifications, variations and embodiments are to be regarded as being within the spirit and scope of the invention.

What is claimed is:

1. An apparatus for storing and molding baseball and softball gloves, comprising:

(a) a rectangular base; said base including two opposing width ends and two opposing length ends;

(b) a cylindrical pedestal; said cylindrical pedestal having first and second ends wherein said first end is permanently affixed to the rectangular base:

(c) a sphere having a diameter corresponding to the size of a softball or baseball, wherein said sphere is removably secured to the second end of the cylindrical pedestal; and (d) a means for securing a baseball or softball glove positioned over the sphere wherein said means is positioned to apply downward pressure on the baseball or softball glove positioned over the sphere to aid in the molding and shaping of the glove.

2. An apparatus for storing and molding baseball and softball gloves as claimed in claim 1, wherein said base further comprises a center; wherein said center includes an aperture for permanently accepting the first end of said cylindrical pedestal.

3. An apparatus for storing and molding baseball and softball gloves as claimed in claim 2, wherein the opposing length ends of said rectangular base comprise an integrally formed indentation, said indentation including opposing apertures for receiving a cylindrical rod.

4. An apparatus for storing and molding baseball and softball gloves as claimed in claim 3, wherein the cylindrical rod is removably secured to the apertures of the indentation integrally formed in the opposing length ends of said rectangular base.

5. An apparatus for storing and molding baseball and softball gloves as claimed in claim 4, wherein said means for securing a baseball or softball glove positioned over the sphere further comprises a stretchable strap positioned around the cylindrical rods and over said sphere in a manner to accept a baseball or softball glove for molding and shaping over said sphere.

* * * * *